United States Patent [19]

Nickerson

[11] 4,412,570

[45] Nov. 1, 1983

[54] WOOD SPLITTER

[76] Inventor: L. Douglas Nickerson, 306 Reid St., Sault Ste. Marie, Ontario, Canada, P6B 4V1

[21] Appl. No.: 262,487

[22] Filed: May 11, 1981

[30] Foreign Application Priority Data

Apr. 23, 1981 [CA] Canada ..... 376097

[51] Int. Cl.[3] ..... B27L 7/00

[52] U.S. Cl. ..... 144/193 A; 74/14; 144/193 E

[58] Field of Search ..... 144/3 K, 193 R, 193 A, 144/193 E; 74/13, 14

[56] References Cited

U.S. PATENT DOCUMENTS

| | | | |
|---|---|---|---|
| 508,221 | 11/1893 | Hill | 144/193 A |
| 3,515,372 | 6/1970 | Couruille | 144/193 A |
| 3,937,260 | 2/1976 | Anderson | 144/193 A |
| 4,076,062 | 2/1978 | Kanik | 144/193 A |
| 4,103,724 | 8/1978 | Braid | 144/193 A |
| 4,128,117 | 12/1978 | Terry et al. | 144/193 A |
| 4,209,046 | 6/1980 | Lavigne | 144/193 A |

FOREIGN PATENT DOCUMENTS

| | | |
|---|---|---|
| 163553 | 6/1914 | Canada . |
| 200140 | 8/1919 | Canada . |
| 375267 | 10/1937 | Canada . |
| 460855 | 7/1949 | Canada . |
| 664578 | 6/1963 | Canada . |
| 779722 | 3/1968 | Canada . |
| 791518 | 8/1968 | Canada . |
| 1064375 | 10/1979 | Canada . |
| 1081093 | 7/1980 | Canada . |

*Primary Examiner*—W. D. Bray

*Attorney, Agent, or Firm*—David A. Burge

[57] ABSTRACT

A wood splitting apparatus is disclosed which includes a horizontal platform supporting a splitting head at one end and an hydraulic ram and pusher plate mounted at the other end. The ram is powered to drive the wood block into the splitting head which has both vertical and horizontal splitting edges. The horizontal splitting edges are set back from the vertical splitting edge to provide a progressive splitting action and the configuration of the horizontal and vertical splitting members is such as to prevent any jamming of the wood block during the splitting operation. The hydraulic ram is preferably powered by a pump driven by means of a vehicle powered roller device. The invention also includes an automatic recycling arrangement for the hydraulic pump to reverse the movement of the block pusher plate after one splitting action has taken place.

5 Claims, 6 Drawing Figures

WOOD SPLITTER

FIELD OF THE INVENTION

This invention relates to wood splitting devices and in particular to a portable wood splitting device incorporating a splitting head with vertical and horizontal knives and a vehicle operated pump means.

BACKGROUND OF THE INVENTION

Due to the increasing scarcity of oil and its higher prices in North America, there has been a renewed interest in the burning of firewood and, as a result, there have been numerous proposals for devices for splitting firewood other than by a hand axe.

Conventionally, wood splitting devices include some form of frame which mounts at one end a hydraulic ram and pusher plate which, when actuated, drives a block of firewood into a splitting wedge or axe head arrangement at the other end of the frame. These devices normally have a small gasoline or similarily powered apparatus for driving the hydraulic pump with about 5 to 8 horsepower.

One of the problems with conventional machines is that, in a more simple single head wedges, a wood block has to be split twice to obtain quarter blocks. Four way knives have also been developed providing one vertical and one horizontal knife at right angles to the vertical knife but this arrangement requires extremely high horsepower. Moreover, after the vertical split is made the two halves of the block tend to slide off the horizontal knives without accomplishing the horizontal split. Moreover, horizontal knives in conventional machines normally force the bottom half of each side block downwardly where some form of interference with the main beam is usually experienced. This jams the machine to the point where stalling occurs, leaving the operator with a wood block that must be removed with a sledge hammer or similar device.

SUMMARY OF THE INVENTION

The present invention provides substantial improvements over conventional wood splitting devices in providing a unit with a unique cutting head configuration having a vertical knife placed substantially forward of its horizontal knives. This allows the machine to apply full pressure of the hydraulic ram to the single vertical knife until the wood block is split vertically and, after the split has progressed several inches, very little pressure is needed to complete the split. The horizontal knife then receives nearly the full pressure of the hydraulic ram to achieve the horizontal split. The progressive splitting action allows the machine of the present invention to function with approximately half the hydraulic pressure needed to operate a conventional machine where both horizontal and vertical knives make contact with the wood at the same time.

A further feature of the splitting head of the present invention is that the horizontal knives have a forward tilt to their upper surface and the leading splitting edge of the horizontal knives are arranged at 90° from the side surfaces of the leading, vertical splitting edge. By setting the horizontal knives at this angle rather than at 90° to the center line of the vertical knife, the two half blocks split by the vertical knife are forced to meet the horizontal knives at right angles and this allows no tendency for the block to slip off towards the outside of the machine.

A further feature of the present invention is that the bottom surface of the horizontal knives are flat and parallel with the main beam or supporting surface of the machine. As mentioned above, the top side of the horizontal knives is forwardly tilted to achieve separation of the wood. This prevents the previously mentioned jamming between the lower part of the horizontal knives and the supporting beam. A straight-through motion of the wood block being obtained due to the parallel surfaces of the lower surface of the horizontal knife and the supporting surface of the machine.

While the present invention can be powered conventionally with a separate gasoline engine or the like, the preferred form of power being a portable roller unit operated by the rear wheel of a vehicle, driving the hydraulic pump. This form of power provides approximately 20 horsepower, a high output for operation of the device. An automatic recycling arrangement is also provided in the hydraulic circuitry and this frees the operator to carry firewood blocks while the splitting is ongoing.

The above-mentioned features provide a machine which can split from 4 to 6 face cords of wood per hour.

In accordance with one broad aspect, the invention relates to a splitting head for wood splitting device, the head comprising a vertical knife adapted for mounting on a support beam of the splitting device with the cutting edge of the vertical knife being at right angles to the support. The vertical knife has side surfaces and a V-shaped leading edge with a pair of wing knives secured to and extending outwardly from the side surfaces of the vertical knife, each wing knife having upper and lower surfaces converging to a single leading edge that is located substantially at right angles to the V-shaped leading edge of the vertical knife. The lower surface of each wing knife is parallel to the support beam on which the head is to be mounted and the upper surface of each wing knife is tilted forwardly, the leading edges of the wing knives being set well back from the leading edge of the vertical knife.

In accordance with another broad aspect, the invention relates to a wood splitting apparatus comprising in combination:

(a) a frame having an elongate platform extending in a horizontal plane, said platform having a forward portion and a rearward portion;

(b) hydraulic ram means mounted on said frame means at the rearward portion of said platform and having a piston rod extensible and retractable in a generally parallel direction to said platform;

(c) a pusher plate fixed to and movable with the outer terminal end of said piston rod;

(d) a splitting head mounted on the forward portion of the platform, said splitting head comprising:

a vertical knife having a leading splitting edge perpendicular to said platform, and a pair of transverse knives fixed to and extending outwardly from oppositely disposed surfaces of the vertical knife, each of said transverse knives having a lower surface extending parallel to and at a preselected distance above said platform and an upper surface disposed such as to form an acute angle with said lower surface, each of said upper surfaces meeting the respective lower surface to form a horizontal splitting edge, extending outwardly at approximately 90° with respect to said leading splitting edge of the vertical knife;

said vertical splitting edge and each of said horizontal splitting edges facing said pusher plate and being disposed relative to each other such that a log pushed into the cutting head contacts the vertical splitting edge prior to contacting the horizontal splitting edges; and (e) pump means for applying fluid under pressure to said hydraulic ram means.

In accordance with a further broad aspect, the invention relates to a wood splitting apparatus comprising in combination:

(a) a frame having an elongate tubular platform extending in a horizontal plane, said platform having a forward end and a rearward end;

(b) an hydraulic ram mounted on said tubular platform at the rearward end thereof and having its piston rod extensible and retractable in generally parallel direction to said platform toward and away from said forward end;

(c) a pusher plate secured to and movable with the outer terminal end of said piston rod for pushing a wood block along said platform;

(d) a splitting head mounted on the forward portion of the platform, said splitting head comprising:

a vertical knife having a leading splitting edge perpendicular to said platform, and a pair of transverse knives fixed to and extending outwardly from oppositely disposed surfaces of the vertical knife, each of said transverse knives having a lower surface extending parallel to and at a preselected distance above said platform and an upper surface disposed such as to form an acute angle with said lower surface, each of said upper surfaces meeting the respective lower surface to form a horizontal splitting edge, extending outwardly at approximately 90° with respect to the sides of said leading splitting edge of the vertical knife; the horizontal splitting edges being set well back from the leading splitting edge of the vertical knife; and said pusher plate whereby when a wood block is pushed into the splitting head the block engages the vertical splitting edge first and then progresses to engage the horizontal splitting edges;

(e) pump means for applying fluid under pressure to said hydraulic ram; and (f) means for powering the pump including at least one roller means engageable with a drive wheel of an automotive vehicle and drivingly connected to the pump.

BRIEF DESCRIPTION OF THE DRAWINGS

The invention is illustrated by way of example in the accompanying drawings in which.

Figure 3:
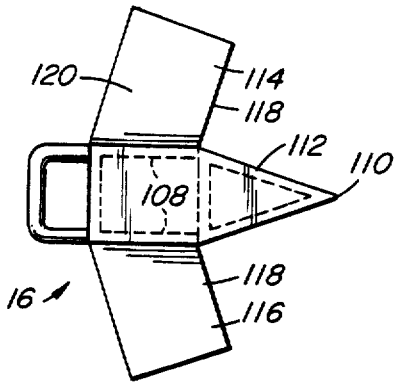
FIG. 3 is a plan view of the splitting head.
Figure 4:
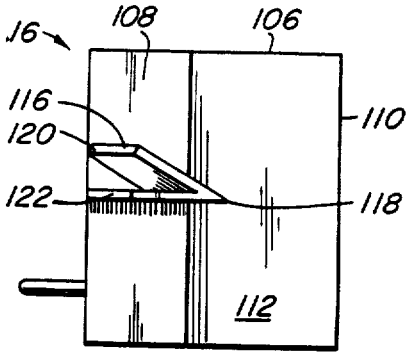
Figure 5:
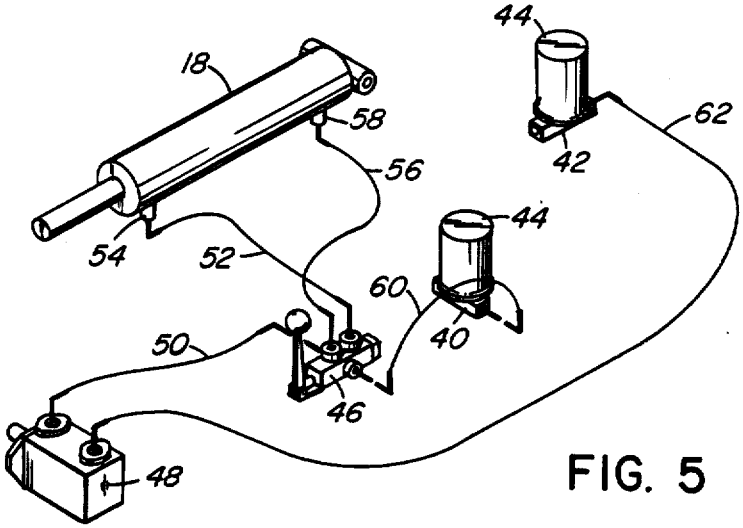

FIGA. 4 is an elevation view of the splitting head in FIG. 3;

FIG. 5 is a schematic view of the hydraulics of the present invention; and

Figure 6:
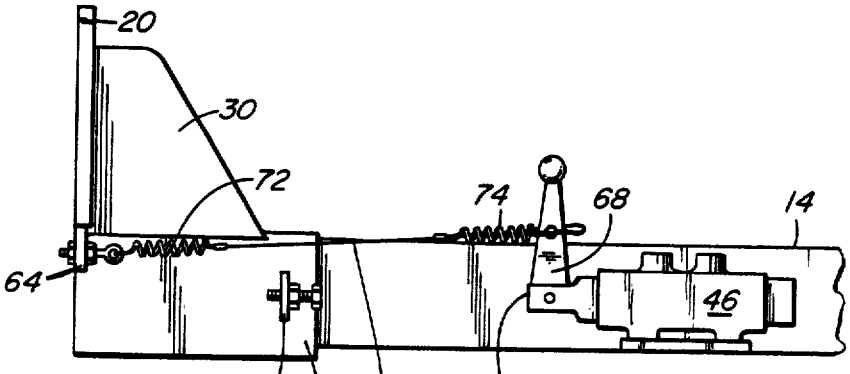

FIG. 6 is an elevation view of the recycling feature of the invention.

DESCRIPTION OF THE PREFERRED EMBODIMENT

Figure 1:
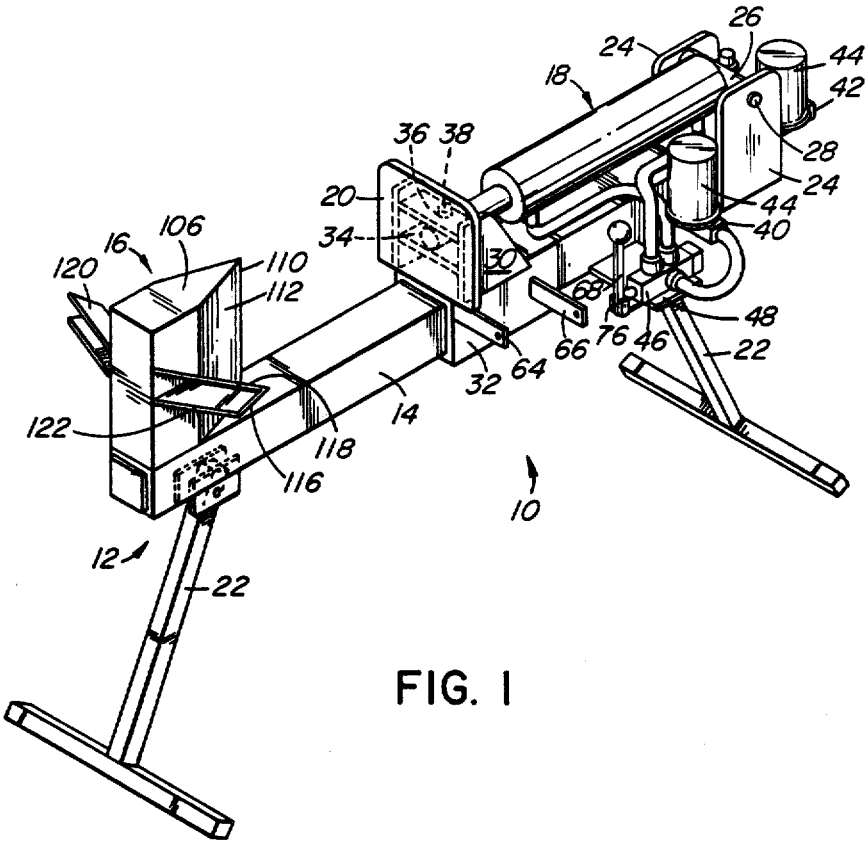
FIG. 1 is a perspective view of the wood splitting apparatus.

Referring to FIG. 1, a wood splitting apparatus is indicated generally at 10 and includes a frame 12 having an elongated platform consisting of a steel tubular beam 14, one end of which supports a splitting head 16 and the other end of which supports a ram 18 having a pusher plate 20 secured to the piston end thereof. Frame 12 includes detachable legs 22 at each end thereof providing portability of the device.

It will be evidence to those skilled in the art that placing a block of wood on the support beam 14 between the pusher 20 and splitting head 16 and actuating the ram 18 will cause the pusher 20 to drive the wood block against the splitting head 16, severing the block into several pieces.

The ram 18 is mounted on one end of the beam 14 by means of a pair of side plates 24 welded to and extending above the upper surface of the beam, the spacing between the plates 24 being sufficient to receive a sleeve 26 on the end of the body of the ram 18, a pin 28 extending through both plates 24 and the sleeve 26 to secure the ram in position.

The pusher plate 20 has a pair of integral side plates 30 welded to a square tubular slide 32 for movement along the beam 14. Side plates 30 have between them a pair of further plates 34 each of which include an aperture aligned with an aperture 36 in the piston rod of the ram 18 and, with the end of the piston rod being placed between the two plates 34 a pivot pin 38 passing through the plates 34 and the aperture 36 retains the pusher plate to the piston end of the ram.

While a separate reservoir for the hydraulic system can be used, in the illustrated, preferred embodiment of the invention the beam 14 also serves as a reservoir for the hydraulic fluid of the device. Accordingly, the walls of the beam 14 are drilled to provide two hydraulic line terminals 40 and 42 each provided with an oil filter 44. A full flow, three way valve 46 is mounted on a support plate 48 of the device for manual and semi-automatic operation of the ram 18.

For the sake of clarity, the hydraulic lines have been omitted from FIG. 1 but are shown schematically in FIG. 5 and turning to that figure it will be seen that the required pressure in the hydraulic system is provided by a pump 48, one terminal thereof being interconnected by a line 50 to the three way valve 46. One terminal on valve 46 is connected by a hose 52 to a terminal 54 at the rod end of the ram 18 and when the fluid is pumped into terminal 54 the piston is retracted drawing the pusher plate 20 away from the splitting head 16. Another terminal of the valve 46 is connected by a hose 56 to terminal 58 at the other end of the ram 18 and it will be appreciated that pumping fluid through hose 56 and terminal 58 causes the pusher plate 20 to be driven towards the splitting head 16.

The third terminal of the valve 46 is connected by hose 60 to line 40 of the reservoir (not shown). The other line 42 being connected to the pump 48 through a hose 62.

Returning to FIG. 1, the tubular slide 32 supporting the pusher plate 20 includes two arms 64 and 66 respectively. These arms are used to actuate the detent valve 46 to provide a recycling arrangement whereby, when one block of wood is being split, the operator can be picking up another block.

Considering both FIG. 1 and FIG. 6, detent valve 46 has an actuating handle 68 which is connected operatively to the arm 64 on the pusher plate 20 through a cable 70 having a spring 72 at the pusher plate end thereof and a lighter spring 74 connects the other end of the cable 70 to the actuating handle 68. Cable 70 passes through the centre of spring 74, around the valve handle 68 with a loop of cable left behind the handle 68, then returns through the centre of spring 74 and the two parts of the cable and the forward end of the spring are all crimped together. As shown in FIG. 5, the hydraulic arrangement is such that the pusher plate assembly 20 moves in the opposite direction to that of the valve handle 68. Thus, if the valve handle 68 is moved away from the cutting head i.e. to the right in FIG. 6, the ram is actuated to move the pusher plate 20 towards the cutting head. The forward motion of the pusher plate 20 drives the block of firewood against the cutting head 16 where it is split vertically, the block progressing approximately 5 inches along the vertical knife and is nearly severed in two when each of these blocks then contacts the horizontal knife to be split horizontally.

As the pusher plate 20 proceeds toward the cutting head 16 the lighter spring 74 is stretched and the loop of cable behind the handle 68 engages the handle to snap it forward through the neutral detent position and into a reverse position, i.e. to the left in FIG. 6. At this point the splitting operation is completed and, due to the movement to the left of the handle 68 the ram 18 is operated in the opposite direction, drawing the pusher plate 20 away from the splitting head. The only function of the heavier spring 72 is to allow manual operation of the valve at all times. The cable 70 and spring 72 are adjusted so that the reversal takes place when the pusher plate 20 is about half an inch from contacting the cutting edge of the vertical portion of the splitting head 16. As the pusher plate 20 returns in the reverse direction, the lug 66 on the tubular slide 32 presses the spool 76 of the valve 46, moving the latter to the neutral position.

Figure 2:
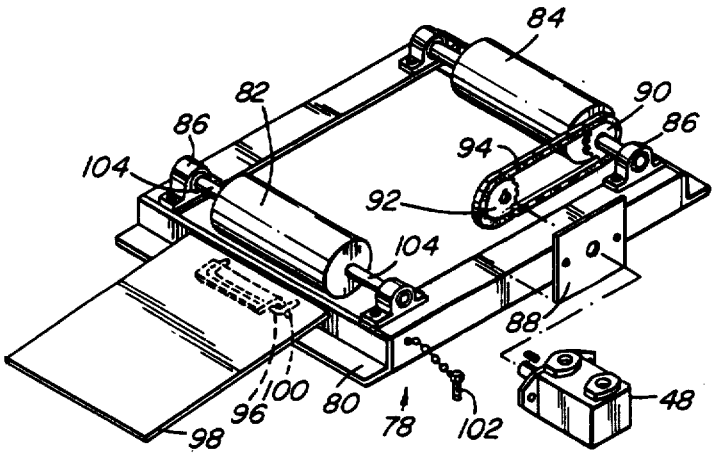
FIG. 2 is a perspective view of the hydraulic power source used with the device of FIG. 1.

While the hydraulic system of the device can be operated through a normal pump and suitable power means such as a small gasoline engine, the preferred arrangement in the present invention is to provide pumping power from the driving wheels of a vehicle such as an automobile, small truck or the like. To this end, a roller drive assembly as shown in FIG. 2 for operation of the pump 48 and of the hydraulic circuitry shown in FIG. 5. The assembly 78 includes a steel base 80 made up of suitable steel angles or the like sufficiently strong to support and carry a pair of spaced, parallel rollers, one being an idle roller 82 and the other a driven roller 84, both rollers being mounted on the base 80 by means of pillow blocks 86. The hydraulic pump 48 is mounted to the base by means of a plate 88, the pump 48 being rotated from the roller 84 through a driving sprocket 90 on the roller and a driven sprocket 92 on the pump, power being transmitted via a chain 94. A chain guard, omitted for clarity, can be mounted on the base to cover the chain and sprockets. For convenience, the base can also include a carrying handle 96 and ramp 98 having a suitable retaining hook 100 for engaging the handle to prevent movement of the ramp relative to the base.

In operation, the roller drive assembly or power unit is positioned so that it and all of the wheels of the vehicle are on level, firm ground. A pin 102 is placed in the shaft of the front roller 82 to lock the roller and the ramp 98 is put in position by locking the cleat 100 behind the handle 96. The unit is lined up behind the left rear wheel of an automobile and the vehicle is backed on so that it is straight with the power unit, the wheel being located approximately in the center of the rollers 82 and 84. The locking pin 102 is removed from the front roller and the ramp is moved off, all wheels being chocked except the one on the power unit. I have found that the vehicle speed taken to about 15 miles an hour is sufficient to produce plenty of power for wood splitting. At this speed, the pump 48 produces hydraulic power or pressures up to approximately 1500 PSI and volumes of up to about 20 gallons per minute.

Returning to FIG. 1, the splitting head 16 has a central head portion 106 fabricated from sheet steel and it can take the illustrated form of a wedge having parallel sides 108 with a converging forward end or it could have a configuration of a straight V in plan view. In either case, the head provides a vertical knife 110 which is mounted on the support beam 14 with the knife 110 facing towards the hydraulic ram and pusher plate 20. The V-shaped leading edge has side surfaces 112 which extend rearwardly towards the parallel side surfaces 108 as shown in FIG. 3. A pair of wing knives 114, 116 are secured to and extend outwardly from the sides of the head 106, each knife of said pair having a cutting edge 118 which is located at substantially right angles with respect to the side surfaces 112 of the V-shaped leading edge 110 as seen clearly in FIG. 3. The knives 114, 116 can be fabricated from single sheets of steel but preferably for heavy duty work, each wing knife has an upper surface 120 and a lower surface 122, the lower surface being parallel with the top of the support beam 14 on which the head is mounted and the upper surface 120 being tilted forwardly. The lower surface 122 of the wing knives insure that the portions of the log split by the wing knives will not jam between those lower surfaces and portions of the support beam 14.

It will also be observed that the cutting edges 118 of the wing knives are set well back from the forward cutting edge 110 of the vertical knife. This allows the hydraulics to apply full pressure of the ram 18 and pusher plate 20 against the vertical knife 110 until the wood is split vertically. After the split has progressed several inches, very little pressure is needed to complete the split and the horizontal knives 114, 116 then receive nearly the full pressure of the hydraulic ram 18 to achieve the horizontal split. Such progressive splitting action allows the machine to function with half the hydraulic pressure a conventional machine requires where both horizontal and vertical knives make contact with the wood at the same time.

While the invention has been described in connection with a specific embodiment thereof and in a specific use, various modifications thereof will occur to those skilled in the art without departing from the spirit and scope of the invention as set forth in the appended claims.

The terms and expressions which have been employed in this specification are used as terms of description and not of limitation, and there is no intention in the use of such terms and expressions to exclude any equivalents of the features shown and described or portions thereof, but it is recognized that various modifications are possible within the scope of the invention claimed.

The embodiments of the invention in which an exclusive property or privilege is claimed are defined as follows:

1. A splitting head for a wood splitting device, said head comprising a vertical knife adapted for mounting on a support beam of the splitting device with the cutting edge of said vertical knife being at right angles to said support, said vertical knife having side surfaces and a V-shaped leading edge in plan view, and a pair of wing knives secured to and extending outwardly from the sides of said vertical knife, each wing knife of said pair having upper and lower planar surfaces converging to a single leading edge that is located substantially at right angles to the side surfaces of the V-shaped leading edge of the vertical knife; the lower surface of each wing knife being parallel to the support beam on which the head is to be mounted, and the upper surface of each wing knife extending upwardly and rearwardly from the leading edge of said wing knife; the leading edges of the wing knifes being set well back from the leading edge of the vertical knife to provide a two stage splitting action on a wood block driven into the head.

2. A splitting head according to claim 1 wherein the side surfaces of the vertical knife are co-extensive with the surfaces of the V-shaped leading edge.

3. A splitting head according to claim 1 wherein the vertical knife comprises a box structure of two spaced, parallel side surfaces joined by an end wall and two converging surfaces extending outwardly of the parallel side surfaces to form the leading edge.

4. A wood splitting apparatus comprising, in combination:

(a) frame means having an elongate platform extending in a horizontal plane, said platform having a forward portion and a rearward portion;

(b) hydraulic ram means mounted on said frame means near a rearward portion of said platform and having a piston rod extensible and retractable in a generally parallel direction to said platform;

(c) a pusher plate fixed to and movable with an outer terminal end of said piston rod;

(d) a splitting head mounted on the forward portion of the platform, said splitting head comprising:

(i) a vertical knife having a leading splitting edge of V-shaped cross section and extending perpendicular to said platform, and a pair of transverse wing knives fixed to and extending outwardly from oppositely disposed surfaces of the vertical knife, each of said transverse knives having a lower surface extending parallel to and at a preselected distance above said platform and an upper surface disposed such as to form an acute angle with said lower surface, each of said upper surfaces meeting its associated lower surface to form a horizontal splitting edge extending outwardly at approximately 90° with respect to side surfaces of the V-shaped leading splitting edge of the vertical knife;

(ii) said vertical splitting edge being located well forward of the horizontal splitting edges, and each of said horizontal splitting edges and the vertical edge facing said pusher plate and being disposed relative to each other such that a log pushed into the cutting head contacts the vertical splitting edge prior to contacting the horizontal splitting edges to provide a two stage splitting action; and, (e) pump means for applying fluid under pressure to said hydraulic ram means.

5. Apparatus according to claim 4 wherein said pump means comprises a frame structure supporting a pair of spaced rollers for rotation by a vehicle wheel, and an hydraulic pump interconnected to at least one of said spaced rollers; a detent valve and actuator for directing hydraulic fluid to said ram, and an automatic recycling arrangement comprising means interconnecting the pusher plate with said detent valve actuator whereby, when said pusher plate nears the end of its stroke adjacent the splitting head, the connecting means moves said valve actuator to reverse the ram and pusher plate.

* * * * *